United States Patent [19]

Inoue

[11] Patent Number: 4,706,958

[45] Date of Patent: Nov. 17, 1987

[54] GOLF BALL

[76] Inventor: Shunsaku Inoue, 12-16, Asahigaoka 2-chome, Ikeda-shi, Osaka-fu, Japan

[21] Appl. No.: 804,941

[22] Filed: Dec. 5, 1985

[30] Foreign Application Priority Data

Apr. 19, 1985 [JP] Japan ..... 60-59446[U]

[51] Int. Cl.[4] ..... A63B 43/00; A63B 45/02

[52] U.S. Cl. ..... 273/213; 40/327

[58] Field of Search ..... 273/213, 183 C; 40/327

[56] References Cited

U.S. PATENT DOCUMENTS 676,506 6/1901 Knight et al. ..... 273/213

FOREIGN PATENT DOCUMENTS 11171 of 1903 United Kingdom ..... 273/213

*Primary Examiner*—George J. Marlo

*Attorney, Agent, or Firm*—Gabriel P. Katona

[57] ABSTRACT

A golf ball being adapted to be capable of being stroked in the direction in which the center of gravity of the ball is made to coincide with the center thereof. Marks are placed on the ball to identify hit points and lead points, the hit points being those at which a first diameter line passing through the center of gravity of the ball intersects the surface of the ball and the lead points being those at which a second diameter line perpendicular to the first diameter line intersects the surface of the ball. Alternatively, marks capable of identifying the direction of the diameter line joining the hit points are set on the lead points.

6 Claims, 10 Drawing Figures

GOLF BALL

FIELD OF THE INVENTION

The present invention relates to a golf ball adapted to be hit in a direction in which the center of gravity of the ball is aligned with the geometrical center thereof by means of setting marks on the surface of the ball.

DESCRIPTION OF THE PRIOR ART

Since a golf ball may generally incur error tolerances during the manufacturing process, the center of gravity of the ball may not coincide with the geometrical central position (so-called centroid) of the ball. Such an occurrence produces aiming inaccuracies during use because, even if the ball is hit well when playing golf, the deviation of the center of gravity from the geometrical center causes the ball to shift during flight horizontally or laterally to the left .or right (the direction depending upon the deviation of the center of gravity). In order to solve this problem, a Japanese prior application (Utility Model Provisional Publication No. SHO (58)-1465), filed by the same applicant as that of the present invention, discloses a golf ball provided with a circumferential line passing through the points at which a diameter line joining the geometrical center of the ball with the center of gravity intersects the surface of the ball. According to this Utility Model, if the ball is set such that the circumferential line, taken from a plan view, is aligned with or directed toward the target, the center of gravity of the ball will be positioned within a plane which includes this circumferential line and is aligned with the direction in which the ball is stroked by a club. This prevents the shift of the ball in a lateral direction caused by the deviation of the center of gravity enabling a user to accurately aim the ball during, for example, putter shots or driver shots because the path of the ball lies along a direction aligned with the plane of the circumference.

According to the aforementioned golf ball, however, although the lateral shift of the ball caused by the deviation of the center of gravity can be prevewnted, there is an inability to maximize the range of the ball. Namely, if the center of gravity of the ball happens to be positioned on the diameter line passing through the geometrical center and if this diameter line is aligned with the stroke direction in which the ball is hit by a club head, the flying ball is shifted neither in the longitudinal direction nor in the vertical direction and accurately propelled with maximum range toward a target at which the ball is aimed. However, according to the foregoing Utility Model, an adequate identifying mark for achieving such a maximum range is not provided so that it is impossible to set the ball to the proper orientation to assure substantial maximization of range. Heretofore, it has not been possible to considerably assure that the direction of the diameter line passing the center of gravity of the ball coincides with the stroke direction. Such a defect is conspiciously incurred, particularly at the driver shot, thereby giving rise to one of the causes for the inability in attaining the maximum range.

OBJECTS OF THE INVENTION

The primary purpose of the present invention is to provide a golf ball which can make the direction of the diameter line passing the center of gravity of the ball coincide with the stroke direction and prevent the deviation of the center of gravity of the ball from shifting the flying direction of the ball in vertical and longitudinal directions, thereby enabling a user to maximize the range of the ball.

Another purpose of the present invention is to provide a golf ball which can be easily oriented such that the direction of the diameter line passing the center of gravity of the ball is made to coincide with the stroke direction.

Further purpose and advantageousness of the present invention will be apparent from the following description.

SUMMARY OF THE INVENTION

These and other objects of the present invention are achieved by a golf ball provided with marks utilizing hit points and lead points, said hit points being those points at which a first diameter line passing through the center of gravity of the ball intersects the surface of the ball, said lead points being those at which a second diameter line perpendicular to said first diameter line intersects the surface of the ball. A user may properly orient the ball for achieving maximum range and minimum lateral deviation by aligning the hit points and lead points in a desired manner.

DETAILED DESCRIPTION OF THE INVENTION

Figure 1:
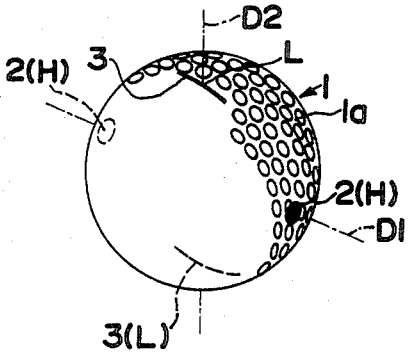
FIGS. 1 to 9 are perspective views of several embodiments of the golf ball according to the present invention.
Figure 10:
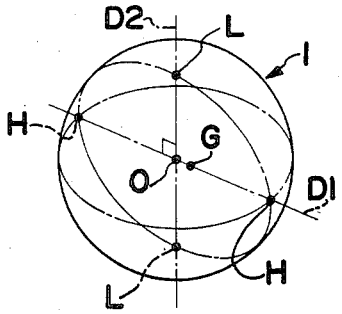
FIG. 10 is a perspective view for describing a hit point and a lead point according to the present invention.

Referring first to FIGS. 1 and 10, there is shown a golf ball 1 having a geometrical center O and a center of gravity G. The line joining the center of gravity G of the ball 1 with the center O is diameter line D1 and the points at which it intersects the surface 1*a* of the ball 1 are the hit points H and H. The points at which a diameter line D2 perpendicular to the diameter line D1 intersects the surface 1*a* of the ball 1 are the lead points L and L. Marks 2 and 2 are put on the hit points H and H on the surface 1*a* of the ball 1. Circular marks 3 and 3 are centered on the lead points L and L and are extended by equal amounts toward the hit points H and H.

It will be apparent that if ball 1 is set such that one circular mark 3 is directed upward and aligned along the direction in which ball 1 is aimed, the ball is oriented such that one mark 2 is on the side where the ball is to be hit by the club head of, for example, a driver. For this reason, a properly oriented shot will permit the club head to hit the end of the diameter line passing through center O of the ball 1 and the center of gravity G, thereby giving an impact to the ball 1, so that the flying distance of the ball 1 is proportionally expanded. That is, the more exactly a user orients the ball, the greater will be the range of the ball. A longitudinal deviation in the aimed direction, caused by the deviation of the center of gravity of the ball 1, is minimized and the ball 1 may be accurately hit to achieve the intended flight path. Proper orientation of the ball 1 is facilitated with reference only to circular marks 3 and mark 2,2. For this reason, circular mark 3 need not be a line and may be made simply a point provided that the mark 2 is sufficiently clear. Furthermore, an acceptable alternative lies not in setting the circular mark 3 upward but in setting the same obliquely to a player in response to his visual angle to the ball 1. Namely, the position of the circular mark 3 may be selected such that it is made easier to set the same, depending upon an inclination of the player.

Figure 2:
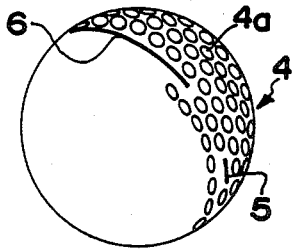
Figure 3:
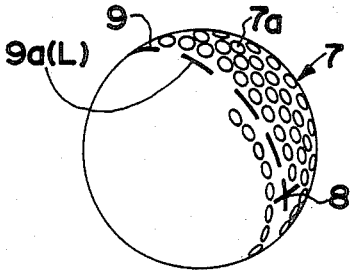
Figure 4:
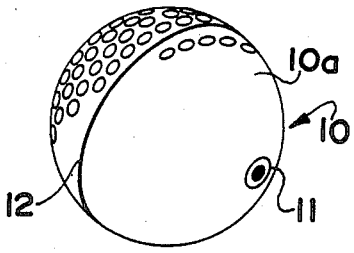

FIGS. 2 to 4 illustrate alternative embodiments. FIG. 2 shows the ball 4 on which a shortened linear mark 5 is set on the hit point H and a longer linear mark 6 is set on the lead point L. FIG. 3 shows the ball 7 on which a dashed line mark 9 is set on the circumference passing through the hit points H and the lead points L and a cross mark 8 is set on one or both hit points H. FIG. 4 shows the ball 10 on which the hit point H is represented by a double round mark 11 and the entire portion of the lead point L is represented by a circumferential mark 12. In FIG. 3 it is more preferable if a mark of line segment 9*a* is differentiated in thickness or color from other parts to constitute the line segment corresponding to the portion of line 9 intersecting lead point L. Other than the aforementioned marks, various kinds of marks may be adopted such as symbols, letter arrangements and the like, or an option in which the hit points and the lead points can be differentiated from each other by means of making the color of the marks different. Furthermore, irregular marks are also permissible in order to identify which of two hit points is nearer to the center of gravity than the other. It is also possible to make the marks set on the hit points H and H different from each other.

Figure 5:
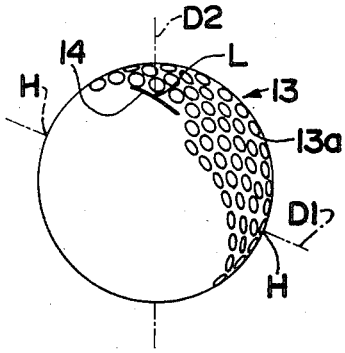

Next, referring to FIGS. 5 to 9 illustrating other embodiments, the ball 13 as shown in FIG. 5 is equipped on the surface 13*a* thereof with the circular mark 14 which is extended by equal amounts to each of the directions of the hit points H and H with the lead point L as the center. If the ball is set such that the circular mark 14 is directed not only upward but along a direction of the same flying course as aimed, the ball 13 has a hit point H positioned to the side being hit by the club head of the driver. Namely, even if the aforementioned setting is made only with the circular mark 14 as a guide, it still enables the shot to be made in a direction in which the center O of the ball 13 coincides with the center of gravity G and the ball is ensured to be extremely naturally set.

Figure 6:
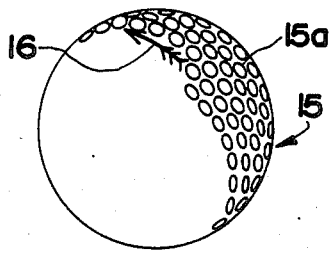

The ball 15 as shown in FIG. 6 equips the lead point L with an arrow mark 16 indicating the direction of one hit point H. The arrow mark 16 may indicate either of the hit points H and H and it would be convenient to the user if one hit point H is particularly selected as used for all the balls 15, thereby determining the direction of the arrow mark 16. Furthermore, it is also acceptable that the arrow marks 16 are directed to both the directions, being different in shape and color from one another. Incidentally, the shape of the arrow mark 16 may be made to be any of forms including a triangular mark, a square mark, and a round mark.

Figure 7:
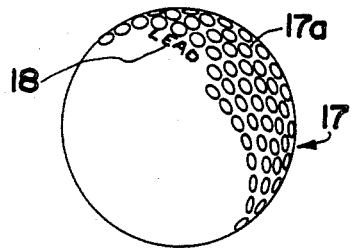
Figure 8:
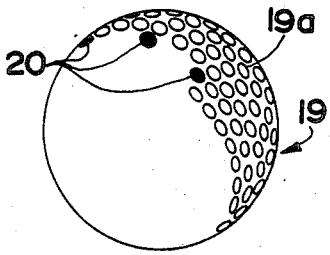
Figure 9:
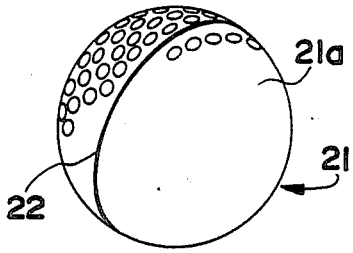

The ball 17 as shown in FIG. 7 equips the lead point L with a letter mark 18 which arranges the letters along a circumference connecting hit points H and H. In that case, the letter mark 18 may, for example, stand for the lead point L or the maker's name or trademark. The ball 19 as shown in FIG. 8 equips the lead point L with multi-dot mark 20 comprising three point marks arranged along the circumference connecting the hit points H and H. The shape, color and number of dots in mark 20 is optional. The ball 21 as shown in FIG. 9 sets a circumferential mark 22 comprising the locus of the lead points L on the surface 21a of the ball, and this circumferential mark 22 represents that the direction perpendicular to the circumferential mark 22 is the diameter connecting hit points H. Under these embodiments further alternatives may be acceptable in which a dot mark is simply set as the lead point L itself, in the vicinity of which a direction indicating mark for showing the direction of one of the hit points H is set, and such an arrangement is, as a whole, adapted to show the position of the lead point L and the direction of one of the hit points H.

Under the aforementioned embodiments of FIGS. 1 to 9, each of these marks may be set on any of one side or both the sides of the lead point L and hit point H respectively.

According to the present invention having the foregoing construction, when making a shot of the ball, it is possible to make the direction of the diameter line passing the center of gravity of the ball coincide with the direction of stroke by the club head and a shift in the flight of the ball incurred by the deviation of the center of gravity of the ball can be prevented. Furthermore, a rotational moment of the ball, caused by the stroke, can be reduced to nil, and all the stroke force can be converted to the force in the aimed direction of the ball, thereby maximizing the range of the ball.

In addition, because all that is required at the setting of the ball is simply to position the mark set on the lead point on the top of the ball and subsequently to aim the ball by means of the mark on the hit point or the mark on the lead point itself, the ball can be easily and exactly set. Since the player can easily discern the mark being positioned on the top of the ball and he has only to swing the club to make the swinging direction coincide with the direction indicated by the mark, he can hit the ball by only taking the desired range into account without the necessity of taking several practice swings to observe the aimed direction and the ball itself, thereby expecting as exact a shot as possible.

What is claimed is:

1. A golf ball characterized in that its center of gravity and geometrical center are not coincident and the surface thereof is marked with hit points and lead points, said hit points being marks on said surface at locations at which a first straight line passing through the center of gravity and the geometrical center of the ball intersects said surface, and said lead points being marks on said surface at locations at which a second straight line passing through the geometrical center of the ball and perpendicular to said first diameter line intersects said surface.

2. A golf ball as defined in claim 1, wherein the marks identifying said lead points further comprise indicia extending toward at least one of said hit points.

3. A golf ball according to claim 1, wherein one of said hit points is differentiated from the other to indicate which is closer to the center of gravity of the ball.

4. A golf ball characterized in that its center of gravity and geometrical center are not coincident and the surface thereof is marked with a linear mark identifying the location of a first straight line passing through the center of gravity and the geometrical center of the ball, said mark set on at least one lead point, said lead point being one of two points on said surface at locations at which a second straight line perpendicular to said first straight line intersects said surface.

5. A golf ball as defined in claim 4, wherein said linear mark further comprises indicia extending toward a selected one of two hit points, said hit points being marks on said surface at locations at which said first straight line intersects said surface.

6. A golf ball according to claim 5, wherein one of said hit points is differentiated from the other to indicate which is closer to the center of gravity of the ball.

* * * * *